US007938626B2

(12) United States Patent
Forgue et al.

(10) Patent No.: US 7,938,626 B2
(45) Date of Patent: May 10, 2011

(54) SHIM FOR A TURBOJET BLADE

(75) Inventors: Jean-Bernard Forgue, Montacher-Villegardin (FR); Jack-Pierre Lauvergnat, Savigny le Temple (FR); Thierry Nitre, Yerres (FR); Patrick Jean-Louis Reghezza, Vaux le Penil (FR)

(73) Assignee: SNECMA, Paris (FR)

( * ) Notice: Subject to any disclaimer, the term of this patent is extended or adjusted under 35 U.S.C. 154(b) by 649 days.

(21) Appl. No.: 11/519,015

(22) Filed: Sep. 12, 2006

(65) Prior Publication Data

US 2010/0226777 A1 Sep. 9, 2010

(30) Foreign Application Priority Data

Sep. 15, 2005 (FR) ..... 05 09420

(51) Int. Cl.
*F01D 5/32* (2006.01)

(52) U.S. Cl. ..... 416/221; 416/220 R

(58) Field of Classification Search ..... 416/219 R, 416/220 R, 221, 248; 24/543, 573.09, 583.11, 24/DIG. 30, DIG. 37
See application file for complete search history.

(56) References Cited

U.S. PATENT DOCUMENTS

| | | | | |
|---|---|---|---|---|
| 2,667,327 | A | 1/1954 | Hardigg | |
| 2,971,743 | A | 2/1961 | Welsh | |
| 4,102,602 | A | 7/1978 | Rottenkolber | |
| 4,980,241 | A | 12/1990 | Hoffmueller et al. | |
| 5,073,084 | A * | 12/1991 | Hirst | 416/219 R |
| 5,160,243 | A * | 11/1992 | Herzner et al. | 416/220 R |
| 5,423,831 | A * | 6/1995 | Nates | 24/543 |
| 5,598,608 | A * | 2/1997 | Naslund | 24/543 |
| 6,098,255 | A * | 8/2000 | Kumada | 24/543 |
| 6,212,742 | B1 * | 4/2001 | Baskin | 24/543 |
| 6,431,835 | B1 * | 8/2002 | Kolodziej et al. | 416/219 R |
| 6,513,767 | B1 * | 2/2003 | Rodgers | 24/543 |

FOREIGN PATENT DOCUMENTS

| | | |
|---|---|---|
| FR | 1.281.033 | 1/1962 |
| GB | 914548 | 1/1963 |
| GB | 1 355 554 | 6/1974 |
| SU | 881354 A2 | 11/1981 |

OTHER PUBLICATIONS

Decision on Grant issued August 19, 2010, in Russian Patent Application No. 2006133128.

* cited by examiner

*Primary Examiner* — Christopher Verdier
(74) *Attorney, Agent, or Firm* — Oblon, Spivak, McClelland, Maier & Neustadt, L.L.P.

(57) ABSTRACT

A shim for a turbomachine blade is disclosed. The shim includes two branches which wrap around flanks of a blade root, and two tabs. Each of the tabs extend from one end of a respective one of the two branches. The tabs are folded towards each other and are interconnected in such a manner as to prevent them from unfolding. Advantageously, the shim includes a connection part which interconnects the tabs in such a manner as to prevent them from unfolding. The connection part is assembled to the tabs in such a manner as to allow the branches of the shim to spread apart. For example, the connection part can be suitable for stretching in the direction for spreading the branches apart.

19 Claims, 4 Drawing Sheets

SHIM FOR A TURBOJET BLADE

The invention relates to a shim for a turbomachine blade, the shim having two branches suitable for wrapping around the flanks of the blade root.

FIELD OF THE INVENTION

More particularly, the invention can relate to a shim for a turbojet fan blade. The shim and the blade root are for positioning inside a housing formed by an axial slot formed in the fan disk. The housing is open upstream while being closed downstream by a wall. The wall is formed by the upstream face of the drum of the low-pressure compressor of the turbojet. It should be observed that the drum is generally of relatively small thickness at this location.

In the present application, an axial direction is defined as being a direction parallel to the axis of rotation of the fan. In addition, the upstream and downstream sides of a part are defined relative to the normal direction of gas flow through the turbojet.

BACKGROUND OF THE INVENTION

With a conventional shim, the following drawback is encountered: during rotation of the fan, the shim moves back and forth axially inside its housing and it strikes the drum of the low-pressure compressor repetitively. The repeated strikes of the shim against the drum damage the drum and shorten its lifetime. In general, it is found that an indentation is formed in the drum and constitutes a crack starter zone. This phenomenon is particularly troublesome in that the drum is a part that is relatively expensive.

In order to avoid such a drawback, it is known to provide the shim with two tabs extending respectively from the upstream ends of its branches, these tabs being folded towards each other. The tabs come into abutment against the front face of the blade root when the shim moves downstream. They thus retain the shim before it strikes the drum.

Nevertheless, such tabs tend to unfold under the effect of the thrust forces exerted on them by the blade root. Once unfolded, the tabs no longer act as abutments and the shim is no longer held so it strikes the drum.

OBJECTS AND SUMMARY OF THE INVENTION

The invention seeks to avoid that problem by providing a shim for a turbomachine blade, the shim having two branches suitable for wrapping around the flanks of the blade root, and having two tabs each extending from one end of a respective one of the two branches, wherein the two tabs are connected together in such a manner as to be incapable of unfolding.

In a first embodiment, said tabs are long enough to be folded one on the other and to be connected together directly. For example, they may be connected together by welding, riveting, bolting, or indeed by mutual engagement one in the other.

In a second embodiment, the shim includes a connection part interconnecting said tabs so as to prevent them from unfolding. This second embodiment makes it possible to provide tabs that are shorter and generally of a shape that is less complex than shapes of the first embodiment.

The connection part used may be of various shapes. Furthermore, the connection part may be secured to the tabs, i.e. assembled to the tabs in such a manner as to prevent any relative movement between itself and the tabs, or on the contrary it may be assembled with the tabs with a certain amount of freedom for relative movement.

During the work that led to the invention, it was found that in order to limit wear on the fan disk and/or the blade roots, it is preferable for the blade roots to be capable of moving inside the shim in directions other than in the axial direction.

Thus, in an advantageous embodiment, the connection part is assembled to the tabs so as to allow the branches of the shim to spread apart (which means that said tabs must be allowed to move apart) thus enabling the blade root to move "laterally" within the shim.

Thus, for example, the connection part may be a rail receiving said tabs inside its two ends.

In order to allow said tabs to move apart, either the two tabs are assembled to the ends of the rail in such a manner that both of them remain free to move in translation along the direction for spreading the branches of the shim apart, or else one of the tabs is secured to the rail, e.g. by welding, while the other one remains free to move in translation.

BRIEF DESCRIPTION OF THE DRAWINGS

The invention and its advantages can be better understood on reading the following description. The description is made with reference to the accompanying figures, in which.

MORE DETAILED DESCRIPTION

Figure 1:
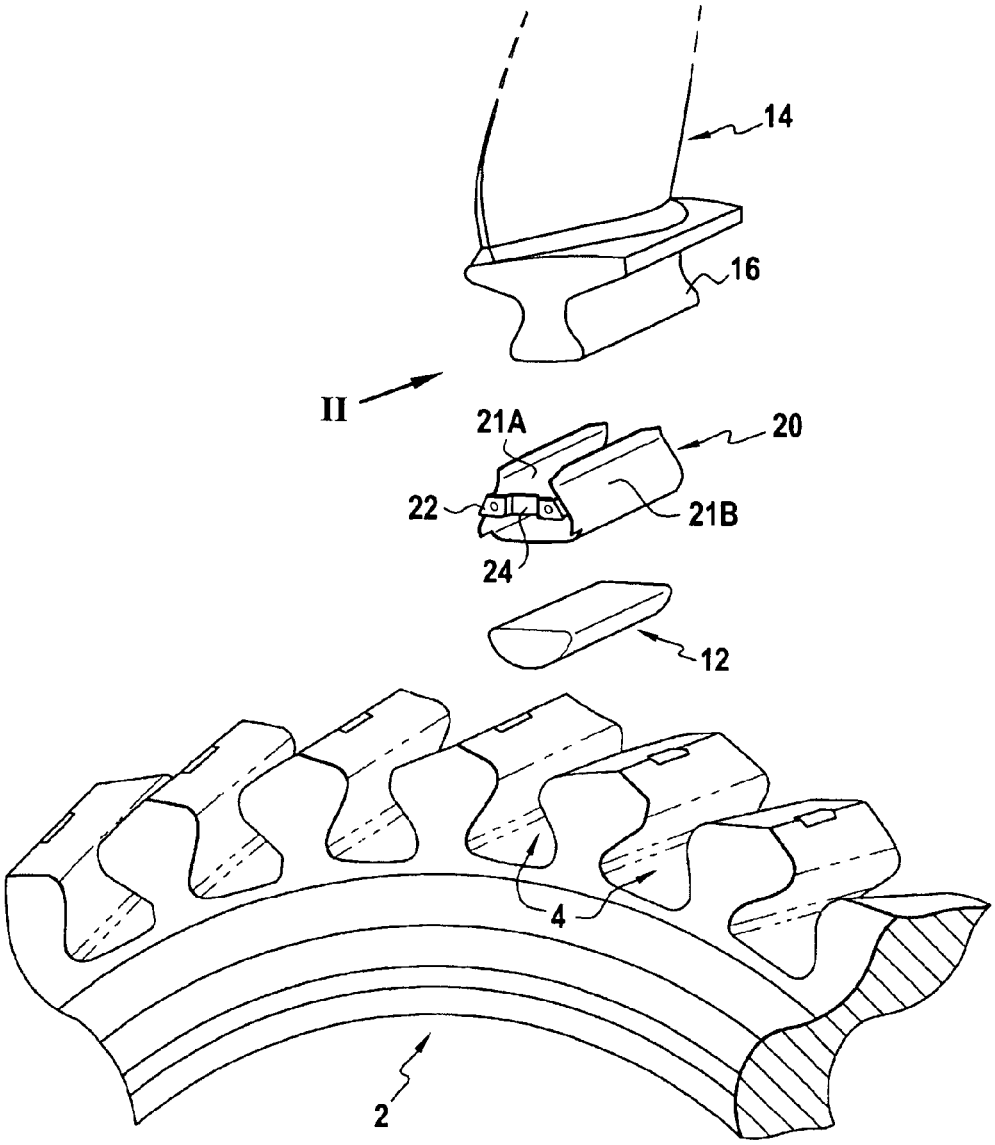
FIG. 1 is a diagrammatic view of parts prior to assembly comprising a portion of a fan disk, a spacer, an example of a shim in accordance with the invention, and a fan blade root.
Figure 2:
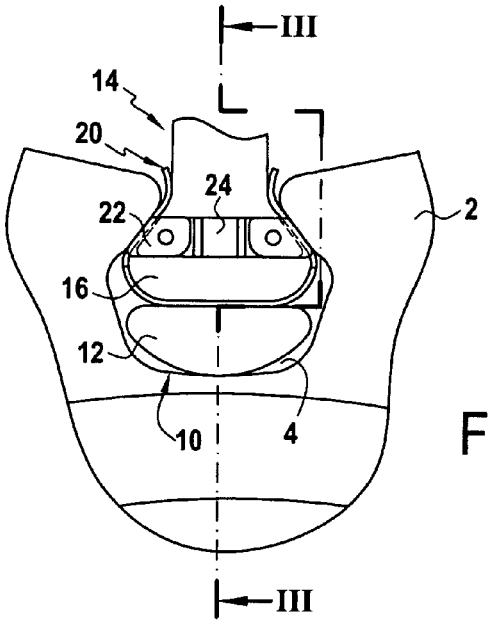
FIG. 2 is a face view looking along arrow II showing the same parts as FIG. 1, once they have been assembled.
Figure 3:
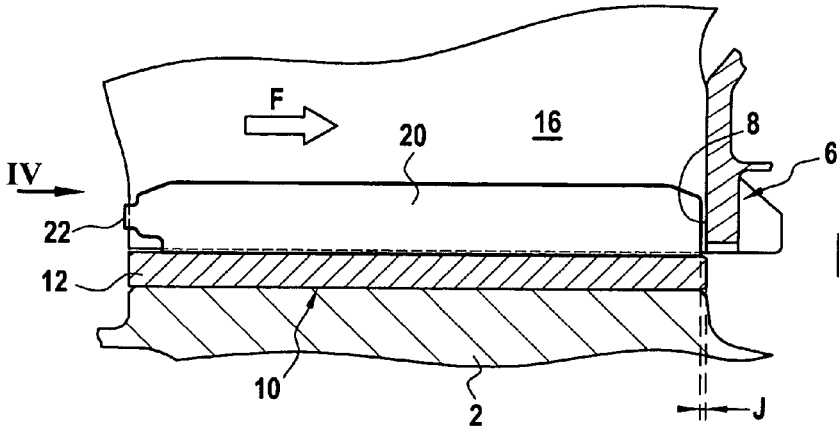
FIG. 3 is an axial section on through the assembly of FIG. 2.

FIGS. 1 to 3 show the following: a fan disk 2 presenting at its periphery numerous axial slots 4 co-operating with the upstream face 8 of the drum 6 of the low-pressure compressor to define a housing 10 suitable for receiving a spacer 12, a piece of shim 20, and the root 16 of a blade 14. It should be understood that analogous assemblies exist that do not include a spacer 12.

The piece of shim 20 comprises two lateral branches 21A and 21B and it is suitable for being wrapped around the blade root 16. As shown in FIG. 2, the shim 20 rests against the spacer 12. The blade root 16, the spacer 12, the drum 6 and the fan disk 2 are made of titanium alloy, for example. The shim 20 is a wear part made of a harder alloy such as the alloy known under the trademark Inconel 718, and its function is to limit wear on the blade root 16 and the fan disk 2. Since the shim 20 is made of a material that is harder than that of the drum 6, repeated impacts between these two elements damage the drum.

In order to avoid such impacts, the shim 20 presents two tabs 22 that project from its upstream end on either side of the blade root and that are folded towards each other. The tabs 22 are connected together by a connection part 24 that prevents them from unfolding. For the shim and for the other parts, the terms "upstream" and "downstream" are defined relative to the normal flow direction of gas through the turbojet, as represented by arrow F in FIG. 3.

Figure 4:
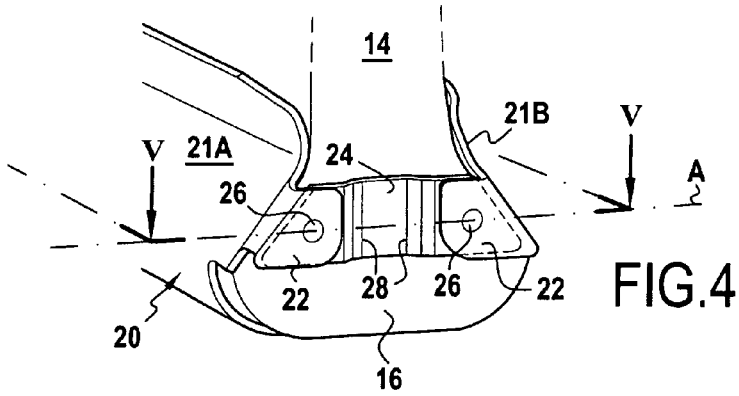
FIG. 4 is a detail view in perspective, seen looking along arrow IV, showing the connection part of the shim of FIGS. 1 to 3.
Figure 5:
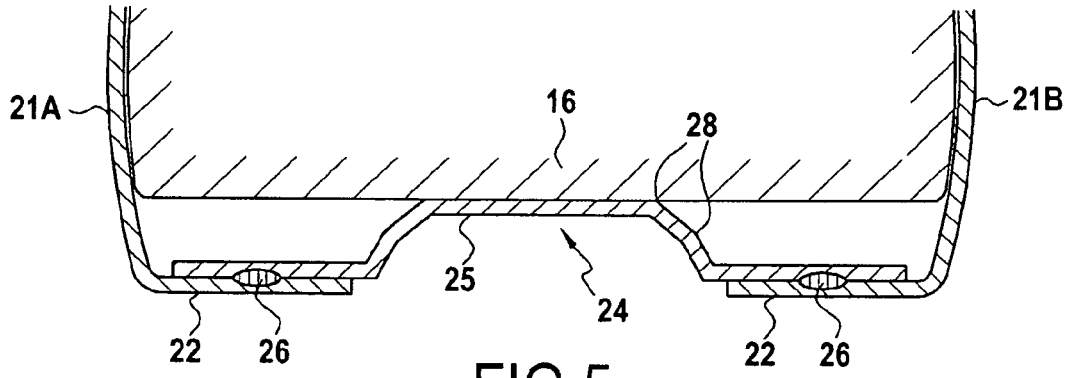
FIG. 5 is a section view on plane V-V showing the FIG. 4 connection part.

In an embodiment, the tabs 22 are secured to the ends of the connection part 24 by welding, by riveting, by bolting, or by any other suitable fastener means. In the example of FIGS. 4 and 5, a spot weld 26 is provided between each of the tabs 22 and the part 24. In addition, the connection part 24 is suitable for stretching in the direction for spreading the branches 21A and 21B apart, i.e. in a direction parallel to the transverse axis A shown in FIG. 4.

In order to allow such stretching, the connection part 24 may be a flexible blade having at least a portion that is curved or folded. In the example of FIGS. 4 and 5, the connection part 24 is a flexible blade presenting a plurality of folds 28 in its middle portion, such that the part 24 bulges downstream, i.e. towards the blade root 16. When the branches 21A and 21B and their respective tabs 22 seek to move apart along the axis A, the bulging portion of the part 24 flattens so that the part 24 stretches and allow the branches 21A and 21B to spread apart.

The fact that the part 24 bulges towards the blade root 16 received inside the shim 20, i.e. downstream, serves to damp impacts between the shim 20 and the blade root 16 since the bulging portion 25 deforms (flattens) on coming into abutment against the blade root 16. In addition, the bulging portion keeps the welds 26 and the tabs 22 spaced apart from the blade root 16 and thus preserves these portions against impacts.

Figure 6:
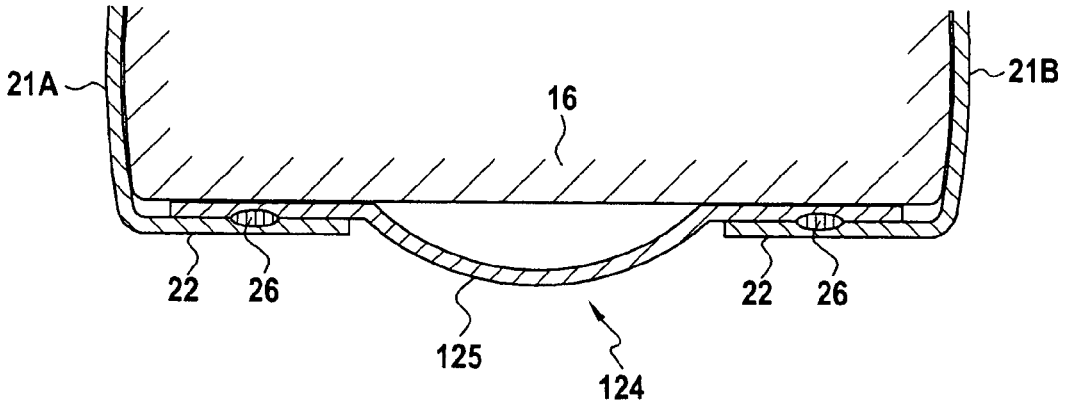
FIG. 6 is a section analogous to that of FIG. 5 showing another type of connection part.

In another example shown in FIG. 6, the connection part 124 can bulge upstream. Under such circumstances, the bulging portion 125 does not come into contact with the blade root 16 (it does not perform a damping function), but it still allows the part 124 to stretch.

Concerning the section of the bulging portion 25, 125, it may present folds and/or at least one curved region. In FIG. 6, the bulging portion 125 is formed by a curved region, whereas in FIG. 5 the bulging portion 25 presents five plane sides interconnected by four folds. It should be observed that the greater the number of folds presented by the bulging portion 25 the easier it is to deform, thus facilitating stretching of the part 24 and damping of the shim 22 against the blade root 16.

Figure 7:
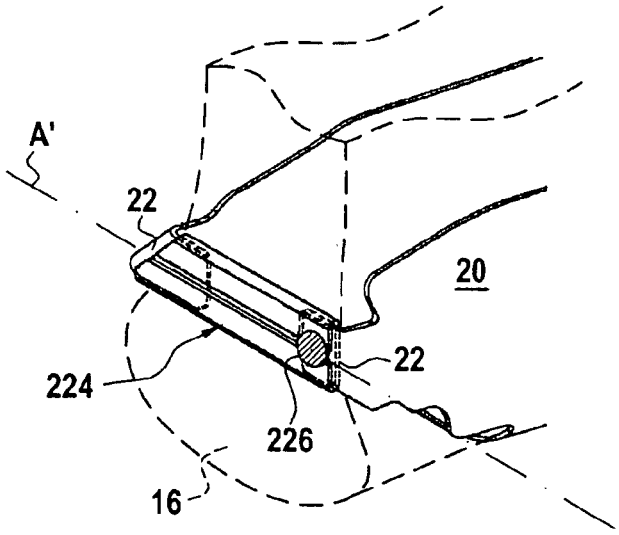
FIG. 7 is a detail view in perspective showing an example of a shim in accordance with the invention fitted with another type of connection part.

In another embodiment, shown in FIG. 7, said connection part is a rail 224 receiving said tabs 22 within its two ends. By way of example, the rail 224 may be made by folding over a plate. In the example of FIG. 7, one of the tabs 22 is secured to one of the ends of the connection part 224, while the other tab 22 is engaged in the other end of the connection part 224 in such a manner as to remain free to move in translation along the direction for allowing the branches to spread apart, i.e. parallel to the transverse axis A'.

In order to make it easier to insert the tab 22 that is free to move in translation within the rail 224, the corresponding end of the rail is chamfered.

By securing at least one of the tabs 22 to the connection part 24, it is ensured that the shim can be handled as a single part. In addition, any risk of the connection part becoming detached in operation is avoided.

Two examples of a shim not including a connection part are described below with reference to FIGS. 8 and 9.

Figure 8:
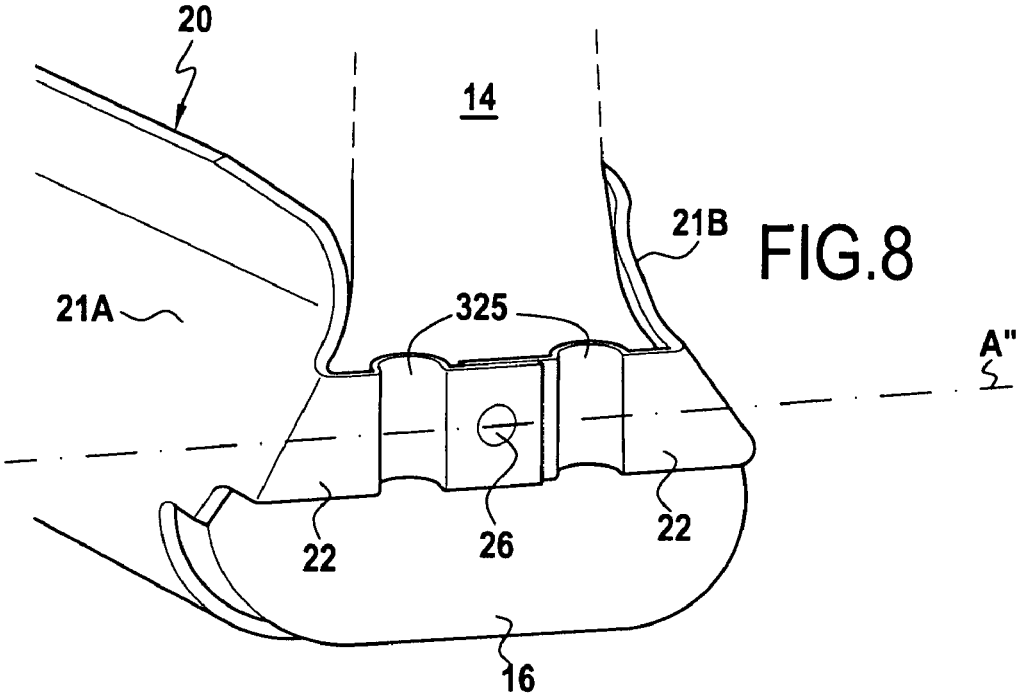
FIG. 8 is a detail view in perspective showing an example of a shim in accordance with the invention without a connection part.

In the example of FIG. 8, the two tabs 22 of the shim 20 overlap and are secured to each other. By way of example, they may be fastened together by a weld spot 26. In order to enable the shim to stretch in the direction A" for spreading the branches 21A and 21B apart, at least one of said tabs is in the form of a flexible blade having at least a portion that is curved or folded. In this example, in order to avoid creating any unbalance, both tabs 22 present respective bulging portions 325 extending downstream and formed by respective curved regions. Alternatively, such bulging portions 325 could present folds and/or could extend upstream. The fact that a bulging portion 325 extends towards the inside of the shim 20, i.e. towards the blade root 16, enables impacts between the shim 20 and the blade root 16 to be damped since the bulging portion 325 deforms on coming into abutment against the blade root 16.

Figure 9:
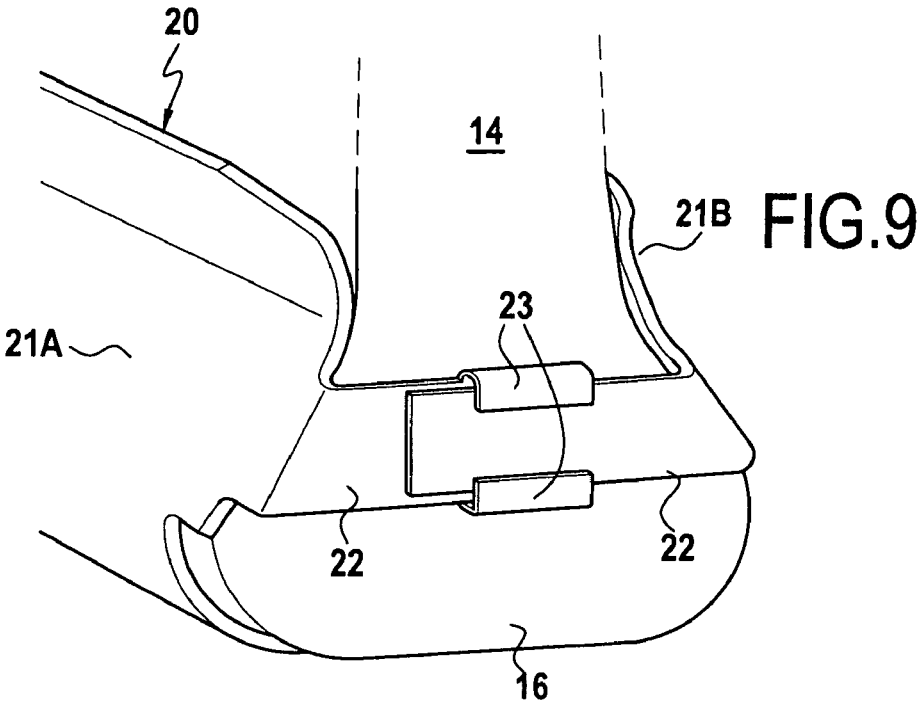
FIG. 9 is a detail view in perspective showing another example of a shim in accordance with the invention without a connection part.

In the example of FIG. 9, the two tabs 22 of the shim 20 overlap and they are mutually engaged in such a manner as to remain free to move in translation in the direction for spreading the branches apart. In this example, one of the tabs 22 presents top and bottom flanges 23 that are folded over in such a manner as to form a rail within which the other tab 22 can slide.

In another example that is not shown, one of the tabs 22 presents an oblong opening within which a stud slides. The stud may either be secured to the other tab 22 or else it may also slide within an oblong opening formed in the other tab 22.

The description above relates to examples of a shim for the fan blades of a turbojet. Nevertheless, such a shim could also be used for other types of blade in a turbomachine, such as, for example, a blade of the low-pressure compressor in a turbojet.

Furthermore, in these examples, the portion of the turbojet that is to be protected, i.e. the drum 6 of the low-pressure compressor, is situated downstream from the shim. Consequently, the tabs 22 extend from the upstream end of the shim 20. Nevertheless, circumstances could arise in which the portion of the turbojet that needs to be protected is upstream from the shim. Under such circumstances, the tabs 22 would extend from the downstream end of the shim 20.

What is claimed is:

1. A shim for a turbomachine blade, comprising:

first and second elongated branches which wrap around flanks of a blade root, each of said branches extending longitudinally between two longitudinal ends;

a first tab which extends from one longitudinal end of the first branch; and a second tab which extends from one longitudinal end of the second branch, wherein the first and second tabs are folded towards each other such that the first and second tabs are incapable of unfolding, and wherein inside surfaces of the first and second tabs are both immediately adjacent to a same end face of the blade root.

2. The shim for a turbomachine blade according to claim 1, further comprising a connection part which interconnects a first end of the first tab and a first end of the second tab such that said first and second tabs are prevented from unfolding.

3. A shim for a turbomachine blade, comprising:

first and second branches which wrap around flanks of a blade root;

a first tab which extends from one end of the first branch;

a second tab which extends from one end of the second branch; and a connection part which interconnects a first end of the first tab and a first end of the second tab such that said first and second tabs are prevented from unfolding, wherein the first and second tabs are folded towards each other such that the first and second tabs are incapable of unfolding, wherein inside surfaces of the first and second tabs face an end face of the blade root, and wherein said connection part is assembled to said first and second tabs such that the first and second branches of the shim are allowed to spread apart.

4. The shim for a turbomachine blade according to claim 3, wherein said connection part is a rail which receives said tabs inside first and second ends of the rail.

5. The shim for a turbomachine blade according to claim 3, wherein the first tab is secured to a first end of the connection part, and the second tab is assembled to a second end of the connection part such that the second tab is able to move in translation along a direction for spreading the branches apart.

6. The shim for a turbomachine blade according to claim 2, wherein the first tab is secured to a first end of the connection part, the second tab is secured to a second end of the connection part, and wherein said connection part stretches in a spreading direction when the branches are spread apart.

7. The shim for a turbomachine blade according to claim 6, wherein said connection part is a flexible blade which includes a portion that is curved or folded.

8. The shim for a turbomachine blade according to claim 1, wherein said first and second tabs overlap and are secured to each other, and wherein at least one of said first and second tabs is a flexible blade which includes a portion that is curved or folded.

9. The shim for a turbomachine blade according to claim 1, wherein said first and second tabs are mutually engaged in such a manner as to remain free to move in translation in a direction for spreading the branches apart.

10. The shim for a turbomachine blade according to claim 7, wherein said curved or folded portion of said connection part bulges towards the inside of the shim.

11. The shim for a turbomachine blade according to claim 8, wherein said curved or folded portion of said tab bulges towards the inside of the shim.

12. A fan blade with a blade root which is wrapped in the shim according to claim 1.

13. A turbojet, including a fan blade with a blade root which is wrapped in the shim according to claim 1.

14. A turbomachine blade according to claim 1.

15. A turbomachine including a blade with a blade root which is wrapped in the shim according to claim 1.

16. The shim for a turbomachine blade according to claim 1, wherein the shim includes a first metal alloy, the blade includes a second metal alloy, and the hardness of the first metal alloy is greater than a hardness of the second metal alloy.

17. The shim for a turbomachine blade according to claim 1, wherein the inside surfaces of the first and second tabs face an upstream face of the blade root.

18. The shim for a turbomachine blade according to claim 1, wherein an inner surface of the first branch and an inner surface of the second branch are not parallel.

19. The shim for a turbomachine blade according to claim 1, wherein each of the branches extend longitudinally from upstream to downstream in an axial flow direction of the turbomachine blade between the longitudinal ends provided at an upstream end and a downstream end.

* * * * *